US006739842B2

(12) United States Patent
Wu

(10) Patent No.: US 6,739,842 B2
(45) Date of Patent: May 25, 2004

(54) PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 36 days.

(21) Appl. No.: 10/189,441

(22) Filed: Jul. 8, 2002

(65) Prior Publication Data

US 2003/0194329 A1 Oct. 16, 2003

(30) Foreign Application Priority Data

Apr. 13, 2002 (TW) ..... 91205255 U

(51) Int. Cl.[7] ..... F04B 49/00; F04B 39/10

(52) U.S. Cl. ..... 417/63; 417/553; 417/555.1; 417/560; 417/569

(58) Field of Search ..... 417/63, 553, 555.1, 417/560, 569

(56) References Cited

U.S. PATENT DOCUMENTS 1,390,559 A * 9/1921 Huntley ..... 92/146
1,776,147 A * 9/1930 Clagett ..... 92/169.1
D323,876 S * 2/1992 Furusawa ..... D23/231
5,964,577 A * 10/1999 Chuang ..... 417/63
6,196,807 B1 * 3/2001 Wu ..... 417/63
6,325,601 B2 * 12/2001 Wu ..... 417/469
6,485,264 B1 * 11/2002 Wu ..... 417/63

* cited by examiner

*Primary Examiner*—Justine R. Yu
*Assistant Examiner*—Michael K. Gray
(74) *Attorney, Agent, or Firm*—Charles E. Baxley

(57) ABSTRACT

A pump includes a base, a tubular portion formed on the base and with an upper end and a lower end, a pressure gauge communicated with the tubular portion near the upper end, a cylinder communicated with the tubular portion near the lower end, a piston movably received in the cylinder, a rod connected with the piston and a nozzle communicated with the lower end of the tubular portion. The tubular portion defines a transverse channel. The cylinder defines an aperture. A first joint defines an axial channel and a transverse channel communicated with the axial channel. The first joint is received in the cylinder. A second joint defines an axial channel, a first transverse channel communicated with the axial channel thereof and a second transverse channel communicated with the axial channel thereof. The second joint is inserted in the transverse channel of the tubular portion, the aperture of the cylinder and the transverse channel of the first joint so that the first transverse channel thereof is communicated with the axial channel of the first joint and the second transverse channel is communicated with the transverse channel of the tubular portion.

12 Claims, 4 Drawing Sheets

PUMP

BACKGROUND OF INVENTION

1. Field of Invention

The present invention relates to a pump.

2. Related Prior Art

Taiwanese Patent Publication No. 446070 teaches an upright pump including internal and external cylinders. This conventional pump includes a base, an internal cylinder mounted on the base, a piston movably received in the internal cylinder, a rod connected with the piston, an external cylinder mounted on the internal cylinder, a pressure gauge assembly mounted on the external cylinder and a nozzle communicated with the pressure gauge assembly through a pipe. The internal cylinder defines a space. A space is confined between the internal cylinder and the external cylinder. The space is communicated with the space through the aperture. The external cylinder defines an aperture near an upper end. The pressure gauge assembly is located at the upper end of the external cylinder. A space defined in the pressure gauge assembly is communicated with the space through the aperture. In pumping, pressurized air flows from the space to the space from which the pressurized air flows the space defined in the pressure gauge assembly through the aperture. This conventional pump is complicated in structure and therefore entails a high cost for fabrication. In addition, the pressurized air has to travel for a distance substantially twice as much as the length of the internal cylinder 20, thus reducing efficiency for pumping.

The present invention is therefore intended to obviate or at least alleviate the problems encountered in prior art.

SUMMARY OF INVENTION

It is the primary objective of the present invention to provide a structurally simple pump equipped with a pressure gauge that can be monitored easily.

According to the present invention, a pump includes a base, a tubular portion formed on the base and with an upper end and a lower end, a pressure gauge communicated with the tubular portion near the upper end, a cylinder communicated with the tubular portion near the lower end, a piston movably received in the cylinder, a rod connected with the piston and a nozzle communicated with the lower end of the tubular portion.

The tubular portion defines a transverse channel. The cylinder defines an aperture. A first joint defines an axial channel and a transverse channel communicated with the axial channel. The first joint is received in the cylinder. A second joint defines an axial channel and first and second transverse channels communicated with the axial channel thereof. The second joint is inserted in the transverse channel of the tubular portion, the aperture of the cylinder and the transverse channel of the first joint so that the first transverse channel is communicated with the axial channel of the first joint and that the second transverse channel is communicated with the transverse channel of the tubular portion.

An annular seal is mounted on the first joint.

Two annular seals are mounted on the second joint so that the first transverse channel of the second joint is positioned between them.

Two annular seals are mounted on the second joint so that the second transverse channel of the second joint is positioned between them.

The second joint is connected, at an end, with the nozzle.

A pipe includes a first end connected with the second joint and a second end connected with the nozzle. A connector may be connected between the pipe and the second joint.

The cylinder defines two apertures through which the second joint is inserted, and the second joint includes, at an end, a head for abutment against the cylinder.

A cup-shaped portion is formed on the tubular portion near the upper end. The cup-shaped portion defines a channel through which the tubular portion is communication with the pressure gauge.

In a first aspect, the first joint is separate from the base. A cylindrical portion extends from the base and defines a transverse channel for receiving the second joint.

In a second aspect, the first joint is integrally formed on the base.

Other objects, advantages and novel features of the invention will become more apparent from the detailed description when taken in conjunction with the drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
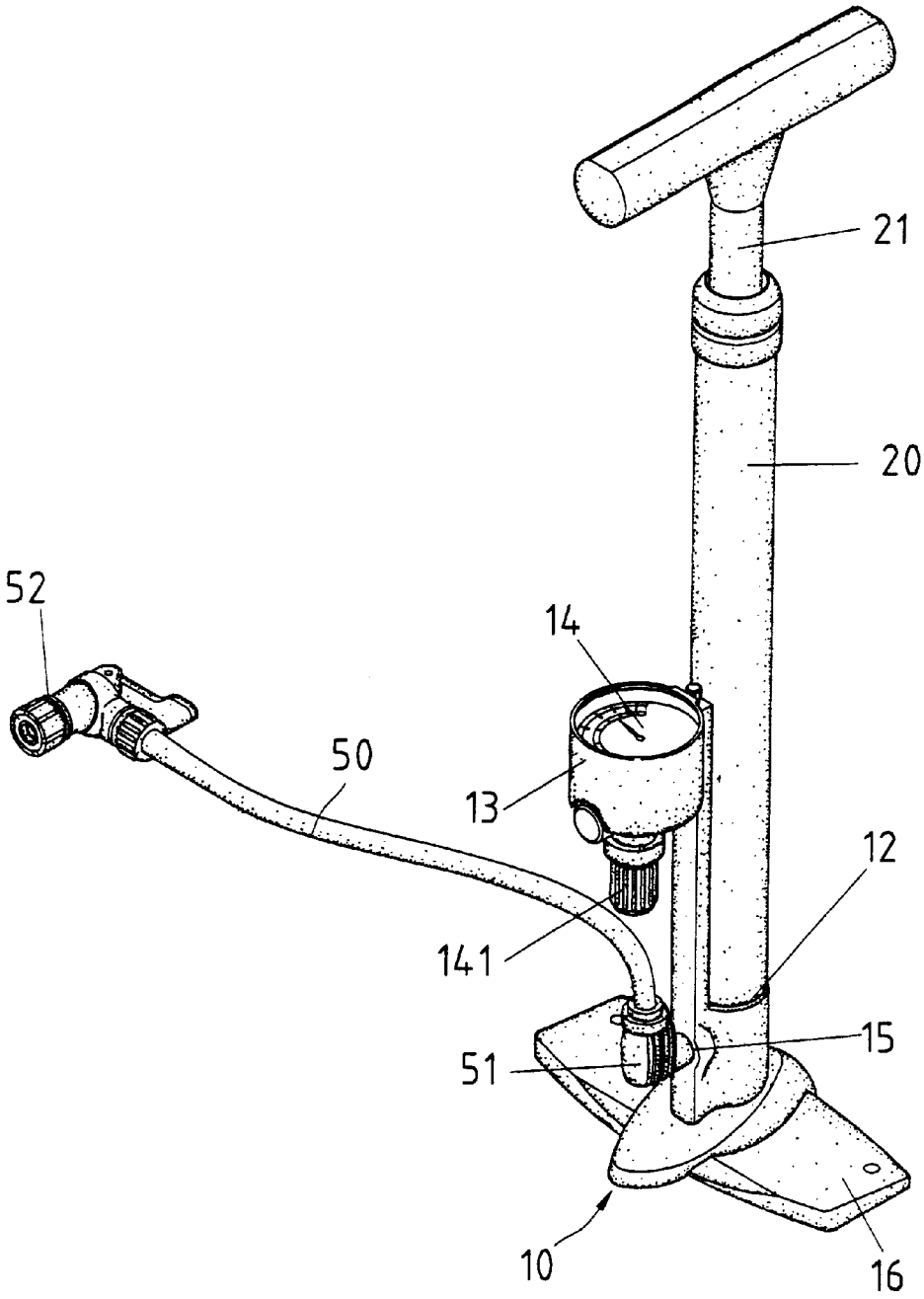
FIG. 1 is a perspective view of a pump according to a first embodiment of the present invention.
Figure 2:
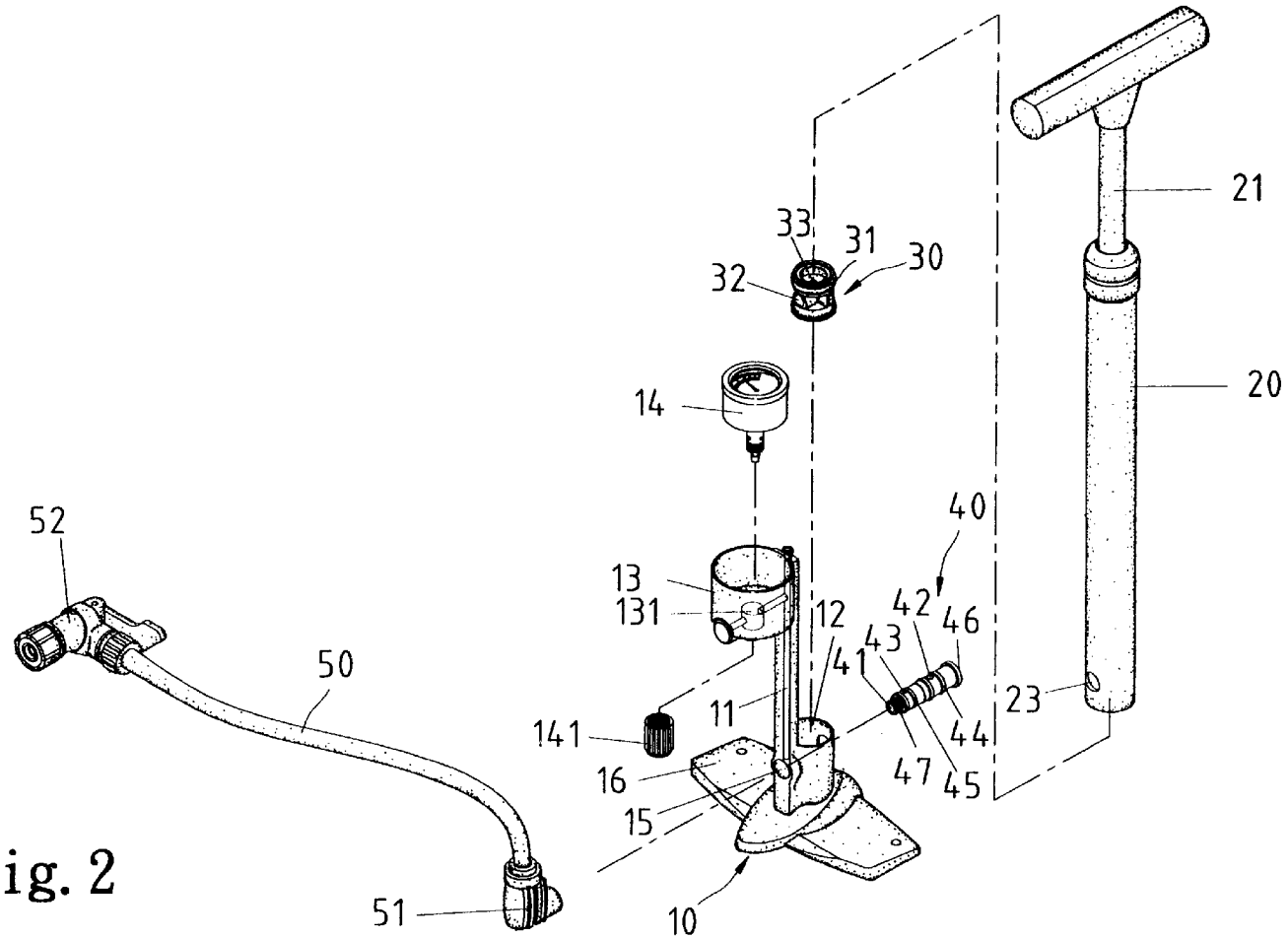
FIG. 2 is an exploded view of the pump according to a first embodiment of the present invention.
Figure 3:
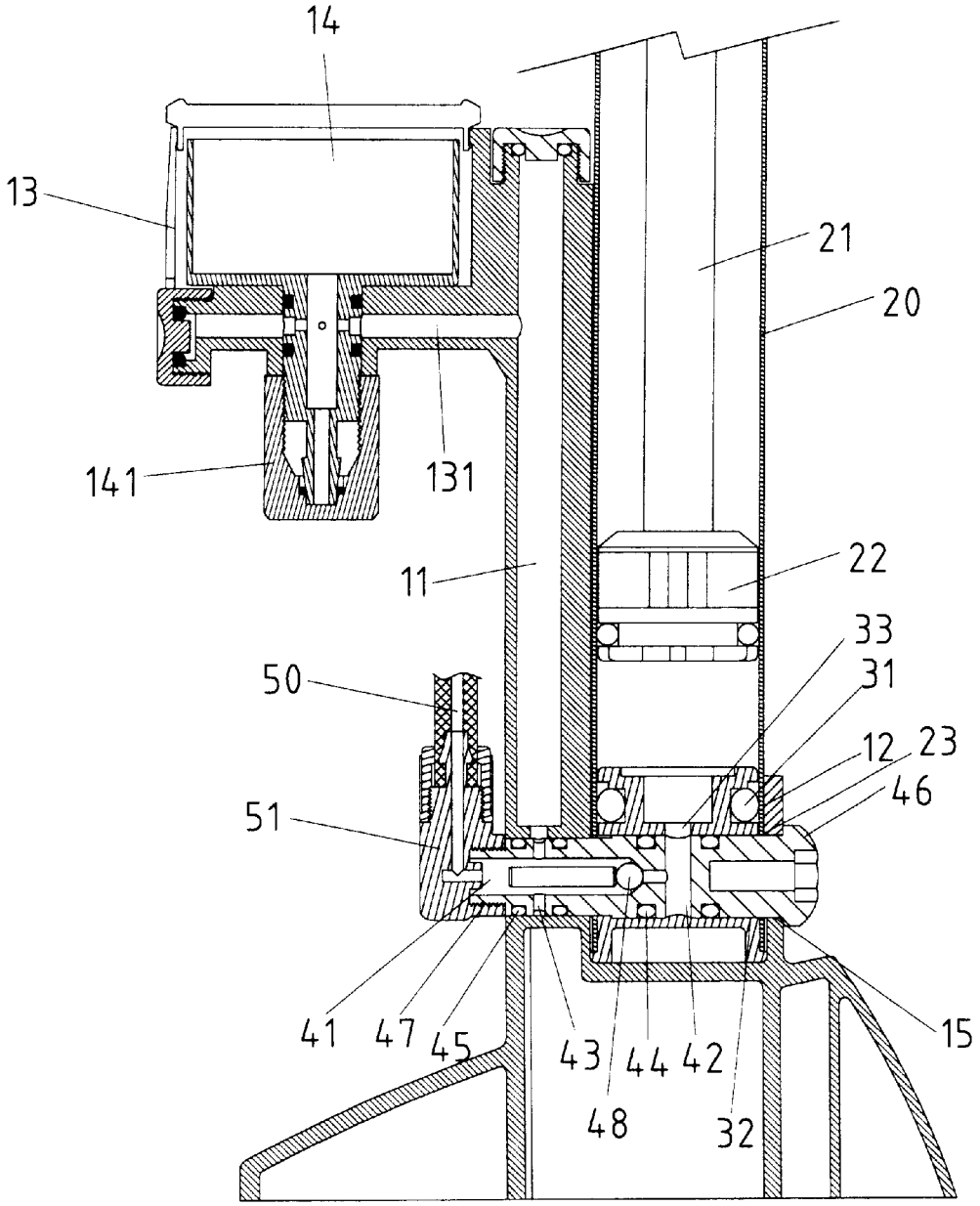
FIG. 3 is a cross-sectional view of the pump according to a first embodiment of the present invention.

Referring to FIGS. 1–3, according to a first embodiment of the present invention, a pump includes a base 10 including a tubular portion 11 formed thereon, a cylindrical portion 12 formed thereon next to a lower end of the tubular portion 11, a cup-shaped portion 13 formed next to an upper end of the tubular portion 11 and two pedals 16 each extending from a side thereof. A channel 15 transversely extends through the tubular portion 11 and the cylindrical portion 12. A bottom of the cup-shaped portion 13 defines an aperture and a channel 131 communicated with the aperture. The tubular portion 11 is in communication with the cup-shaped portion 13 through the channel 131.

A pressure gauge 14 includes a tubular portion extending from a bottom thereof and defining at least one aperture. The pressure gauge 14 is received in the cup-shaped portion 13 so that the tubular portion of the former is inserted through the aperture defined in the bottom of the latter. The aperture defined in the tubular portion of the pressure gauge 14 is communicated with the channel 131. Thus, the pressure gauge 14 is communicated with the tubular portion 11. A cap 141 is engaged with the tubular portion of the pressure gauge 14, thus retaining the pressure gauge 14 in the cup-shaped portion 13.

The pump includes a cylinder 20, a piston 22 movably received in the cylinder 20 and a rod 21 operatively connected with the piston 22. The cylinder 20 defines two apertures 23 near a lower end thereof. The cylinder 20, the piston 22 and the rod 21 will not be described in detail for being conventional.

A first joint 30 on which an annular seal 31 is mounted defines an axial channel 33 and a transverse channel 32 communicated with the axial channel 33.

The first joint 30 is pressed into a lower end of the cylinder 20. The annular seal 31 improves sealing between the first joint 30 and the cylinder 20.

A second joint 40 defines an axial channel 41, a first transverse channel 42 communicated with the axial channel 41 and a second transverse channel 43 communicated with the axial channel 41. A check valve 48 is installed in the axial channel 41 in order to allow air to flow from the first transverse channel 42 to the second transverse channel 43 only, not vice versa. Two annular seals 44 are mounted on the second joint 40. The first transverse channel 42 is positioned between the annular seals 44. Two annular seals 45 are mounted on the second joint 40. The second transverse channel 43 is positioned between the annular seals 45. The second joint 40 includes a head 46 at one end and a thread 47 at an opposite end.

The second joint 40 is inserted in the channel 15, the apertures 23 of the cylinder 20 and the transverse channel 32 of the first joint 30. The axial channel 33 of the first joint 30 is communicated with the first transverse channel 42 of the second joint 40. The annular seals 44 ensure that air flows from the axial channel 33 of the first joint 30 to the first transverse channel 42 of the second joint 40. The second transverse channel 43 of the second joint 40 is communicated with the channel defined in the tubular portion 11. The annular seals 45 ensure that air flows from the second transverse channel 43 of the second joint 40 to the channel of the tubular portion 11. Through the channel of the tubular portion 11 and the channel 131 of the cup-shaped portion 13, the air further flows to the pressure gauge 14 for measurement.

A pipe 50 includes an end connected with a connector 51 and another end connected with a nozzle 52. The connector 51 includes an internal face formed with a thread.

The thread of the hollow connector 52 is engaged with the thread 47 of the second joint 40. The axial channel 41 is in communication with a channel defined in the connector 51. The nozzle 52 can be engaged with a valve of an article to be pumped.

Figure 4:
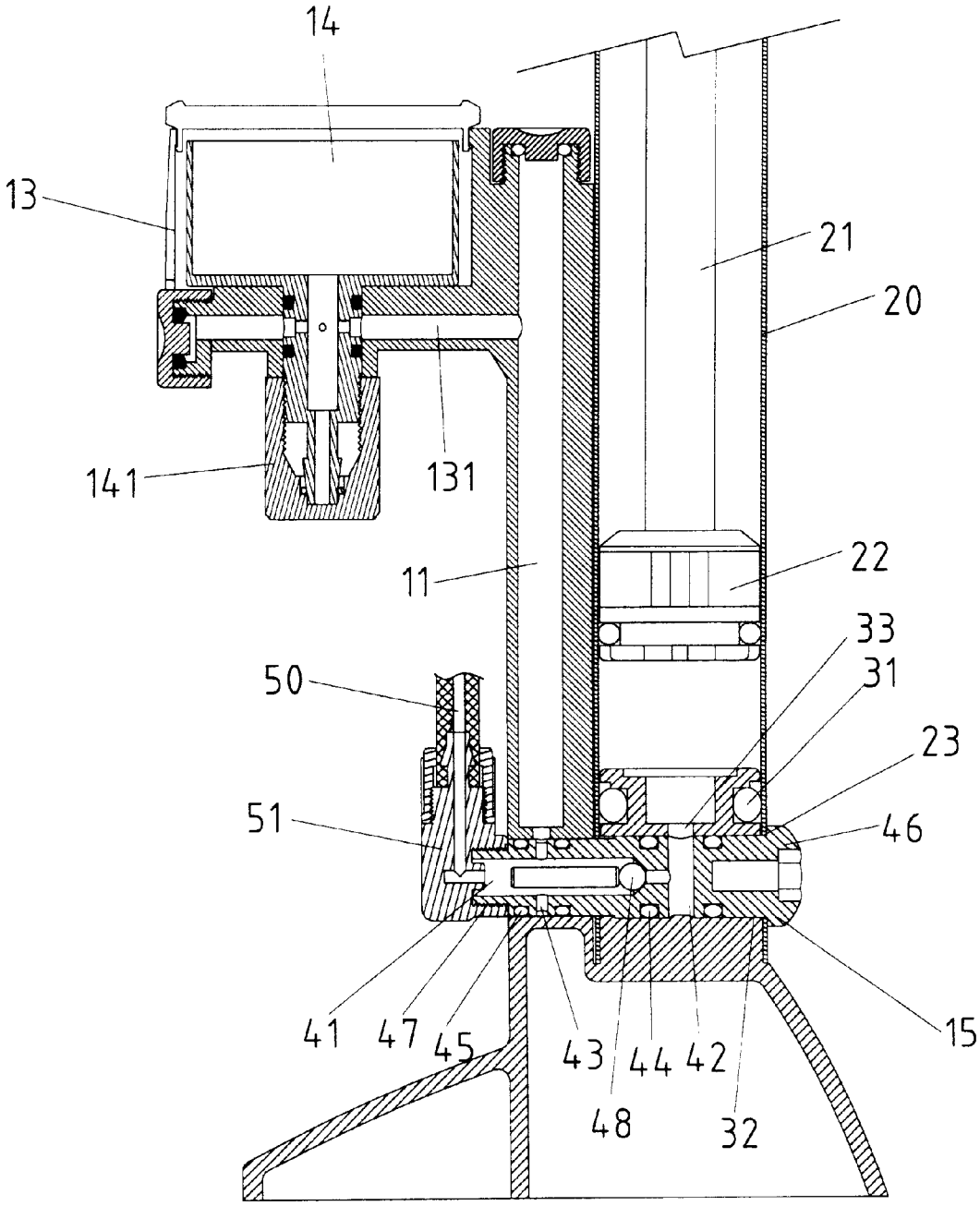
FIG. 4 is a cross-sectional view of a pump according to a second embodiment of the present invention.

FIG. 4 shows a pump according to a second embodiment of the present invention. The pump of the second embodiment is identical to the pump of the files first embodiment except that the second joint 30 is formed integrally on the base 10 and that the cylindrical portion 12 is deleted.

The present invention has been described via detailed illustration of the embodiments. Those skilled in the art can derive many variations from the embodiments without departing from the scope of the present invention. Therefore, the embodiments shall not limit the scope of the present invention. The scope of the present invention is defined in the attached claims.

What is claimed is:

1. A pump comprising base (10), a tubular portion (11) formed on the base (10) and with an upper end and a lower end, a pressure gauge (14) communicated with the tubular portion (11) near the upper end, a cylinder (20) communicated with the tubular portion (11) near the lower end, a piston (22) movably received in the cylinder (20), a rod (21) connected with the piston (22) and a nozzle (52) communicated with the lower end of the tubular portion (11) further comprising a first joint (30) defining an axial channel (33) and a transverse channels (42, 43) communicated with the axial channel (30) being received in the cylinder (20) and a second joint (40) defining an axial channel (41) thereof, wherein the tubular portion (11) defines a transverse channel (15), the cylinder (20) defines an aperture (23), the second joint (40) is inserted in the transverse channel (15) of the tubular portion (11), the aperture (23) of the cylinder (20) and the transverse channel (32) of the first joint (30) so that the first transverse channel (42) is communicated with the axial channel (33) of the first joint (30) and that the second transverse channel (43) is communicated with the transverse channel (15) of the tubular portion (11).

2. The pump according to claim 1 including an annular seal (31) mounted on the first joint (30).

3. The pump according to claim 1 including two annular seals (44) mounted on the second joint (40) so that the first transverse channel (42) of the second joint (40) is positioned between the annular seals (44).

4. The pump according to claim 1 including two annular seals (45) mounted on the second joint (40) so that the second transverse channel (43) of the second joint (40) is positioned between the annular seals (45).

5. The pump according to claim 1 wherein the second joint (40) is connected, at an end, with the nozzle (52).

6. The pump according to claim 5 including a pipe (50) with a first end connected with the second joint (40) and a second end connected with the nozzle (52).

7. The pump according to claim 6 including a connector (51) connected between the pipe (50) and the second joint (40).

8. The pump according to claim 1 wherein the cylinder (20) defines two apertures (23) through which the second joint (40) is inserted.

9. The pump according to claim 8 wherein the second joint (40) includes, at an end, a head (46) for abutment against the cylinder (20).

10. The pump according to claim 1 wherein the first joint (30) is separate from the base (10).

11. The pump according to claim 10 including a cylindrical portion (12) extending from the base (10) and defining a transverse channel (15) for receiving the second joint (40).

12. The pump according to claim 1 wherein the first joint (30) is integrally formed on the base (10).

* * * * *